United States Patent [19]

Meier

[11] Patent Number: 4,480,771

[45] Date of Patent: Nov. 6, 1984

[54] ROTARY NOZZLE SYSTEM FOR METALLURGICAL VESSELS

[75] Inventor: Ernst Meier, Wollerau, Switzerland

[73] Assignee: Stopinc AG, Baar, Switzerland

[21] Appl. No.: 148,594

[22] Filed: May 12, 1980

[30] Foreign Application Priority Data

May 25, 1979 [CH] Switzerland ..... 4891/79

[51] Int. Cl.[3] ..... B22D 41/08

[52] U.S. Cl. ..... 222/598; 222/512; 222/548

[58] Field of Search ..... 222/598, 600, 548, 555, 222/512, 590

[56] References Cited

U.S. PATENT DOCUMENTS

| | | | |
|---|---|---|---|
| 3,760,992 | 9/1973 | Bieri | 222/598 |
| 3,764,047 | 10/1973 | Inoue et al. | 222/598 |
| 3,912,134 | 10/1975 | Poran | 222/598 X |
| 4,314,659 | 2/1982 | Shapland | 222/590 |

FOREIGN PATENT DOCUMENTS

| | | | |
|---|---|---|---|
| 374454 | 6/1964 | Switzerland | 222/598 |
| 1417824 | 12/1975 | United Kingdom . | |

OTHER PUBLICATIONS

"NKK Drehscheiber": Tokyo Yogyo Co. Ltd.

"Changeable Collector Nozzles": Interstop, Apr. 1978; M. H. Detrick Co., Chicago, Ill.

*Primary Examiner*—David A. Scherbel

*Attorney, Agent, or Firm*—Werner W. Kleeman

[57] ABSTRACT

A rotary nozzle system for metallurgical vessels, especially steel ladles, whose stationary closure portion or part contains a refractory bottom plate and whose rotatable closure portion or part contains a rotatable toothed rim mounted at the stationary closure portion and a refractory slide plate which bears against the bottom plate. There is solved the problem of enabling a rapid, uncomplicated exchange, especially of the bottom plate and the slide plate with the particular task of automatically reestablishing each time a condition which ensures for operational reliability of the rotary nozzle system. This is obtained by constructing the rotatable closure portion or part as a housing having a rigid cover member which is detachably connected at the rotatable toothed rim. Internally of the housing there is located a pressure plate which receives the slide plate. Since the pressure plate is in direct rotatable engagement with the rotatable toothed rim and is supported, by means of spring elements, at the housing, preferably at the cover member, there is realized a stable construction with a predictable force flow. In particular, the contact or pressing forces are independent of the rotational movement and act directly upon the slide plate. For plate exchange it is only necessary to remove the housing cover, while the rotary drive continuously is maintained in engagement at the rotatable toothed rim.

36 Claims, 6 Drawing Figures

ROTARY NOZZLE SYSTEM FOR METALLURGICAL VESSELS

BACKGROUND OF THE INVENTION

The present invention relates to a new and improved rotary nozzle system for metallurgical vessels, especially steel casting ladles.

Generally speaking, the rotary nozzle system for metallurgical vessels, is of the type comprising a stationary closure portion or part containing a refractory bottom plate and a closure portion or part which is rotatable relative to the stationary closure portion. The rotatable closure portion contains a rotatable toothed rim mounted at the stationary closure portion and a refractory slide plate which resiliently bears against the bottom plate.

With heretofore known rotary nozzle systems of this type, for intance as disclosed in German patent publication No. 2,404,881 or U.S. Pat. No. 3,511,471, a metallic support plate, which receives the refractory slide plate, is supported at its periphery at a stationary bearing or mounting ring. The bearing ring is secured, in turn, by means of springs at a base plate. These springs transmit the contact force for the slide plate, by means of the bearing ring, to the support plate. The rotary drive—in one case, accomplished by means of a gearing drive and, in the other case, by means of an insertable hand lever—thus engages directly at the support plate. Exchange of the refractory closure elements or parts, especially the bottom plate and the slide plate, which must be replaced after a few pours or teeming operations to ensure for proper operation, is cumbersome with these prior art rotary slide systems and cannot satisfy the high operational security which is demanded. In order to render the aforementioned refractory elements or parts accessible, it is necessary to dismantle, each time along with the support plate, also the bearing ring and its holding springs and to interrupt the mechanical rotary drive. Upon renewed assembly there particularly exists the difficulty of again adjusting, through the tensioning of the springs, the uniform surface compression between the slide plate and the bottom plate which is needed for achieving a positive sealing action, since the spring forces which engage the bearing ring far outside of the edges of the plates, produce considerable tilting moments at the sealing surfaces and excessive, locally differing edge compression. Moreover, the direct rotatable mounting of the support plate is incompatible with the intensive and considerably varying thermal load of such support plate which is caused by the molten metal.

According to a further state-of-the-art rotary nozzle system, as disclosed in Austrian Pat. No. 322,753, there is formed a spherical sealing surface between a concave, refractory bottom portion and a sleeve-shaped refractory slide element or part having a convex top surface. The slide element or part is mounted for corotation in a central opening of a metallic disc, which is threadably connected at the outer periphery with the rotatable toothed rim and is constructed as a plate spring. This plate spring therefore must transmit the drive moment to the slide element and at the same time apply the contact pressure. By virtue of the combined effects of the material wear or loading and the high temperatures to which such metal spring is exposed, there is however rendered quite questionable whether there can be achieved a positive interconnection of the elements forming the rotary nozzle system so as to ensure for the requisite sealing action. Even upon tightening the attachment or fastening screws it is not possible to determine the stressed state of the plate spring, and with this prior art arrangement there cannot be accomplished reliable centering and guiding of the slide element.

SUMMARY OF THE INVENTION

Therefore, with the foregoing in mind it is a primary object of the present invention to provide a new and improved construction of a rotary nozzle system for metallurgical vessels, which is not afflicted with the aforementioned drawbacks and limitations of the prior art constructions.

Another and more specific object of the present invention aims at the provision of a new and improved construction of rotary nozzle system which enables a rapid and uncomplicated exchange of its refractory wearing elements, especially the slide plate and the bottom plate, at the casting ladle or equivalent vessel.

In keeping with the immediately preceding object it is a further objective of the invention to provide a rotary nozzle system which, while satisfying the previously stated objectives, enables, following each exchange, automatically reestablishing a condition at the rotary nozzle system which ensures for positive operation thereof.

Still a further significant object of the present invention aims at providing a new and improved rotary nozzle system for metallurgical vessels, which is relatively simple in construction and design, economical to manufacture, extremely reliable in operation, enables relatively rapid and positive replacement of its refractory wearing parts, particularly in a manner such that there is again reestablished the requisite sealing action at the rotary nozzle system and its operational integrity is maintained.

Now in order to implement these and still further objects of the invention, which will become more readily apparent as the description proceeds, the rotary nozzle system of the present development is manifested by the features that the rotatable closure part or portion is constructed as a housing having a rigid cover which is detachably secured at the rotatable or rotary toothed rim. Internally of the housing there is contained a pressure plate which receives the slide plate. The pressure plate is in direct rotatable engagement with the rotatable toothed rim and is supported, by means of spring elements, at the housing. With this arrangement there is obtained a stable construction with predictable force flow, in that the contact forces are applied independent of the rotational movement and directly at the slide plate.

According to a further aspect of the invention, the spring elements are arranged in the cover member or cover and the latter is connectable, by means of tensioning elements and stop or impact surfaces, in a rigid fashion with the rotatable toothed rim. By virtue of this design there is realized a particularly beneficial distribution of the spring or resilient elements internally of a rigid housing.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
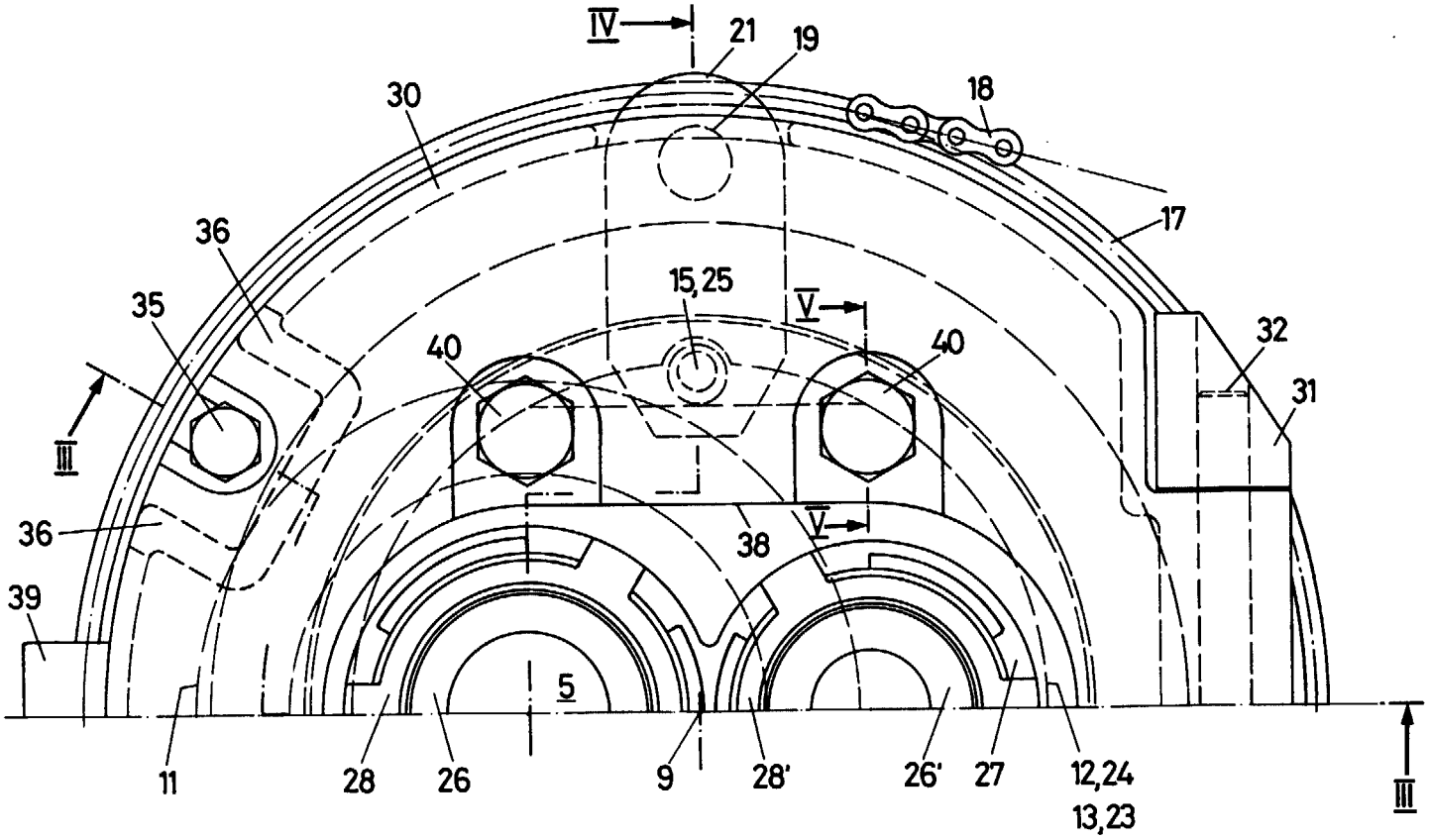
FIGS. 1 and 2 respectively show one-half of a rotary nozzle system viewed from the bottom and constructed according to the invention, wherein in the illustration of FIG. 2 there has been partially broken away the housing cover in order to reveal internal structure.
Figure 2:
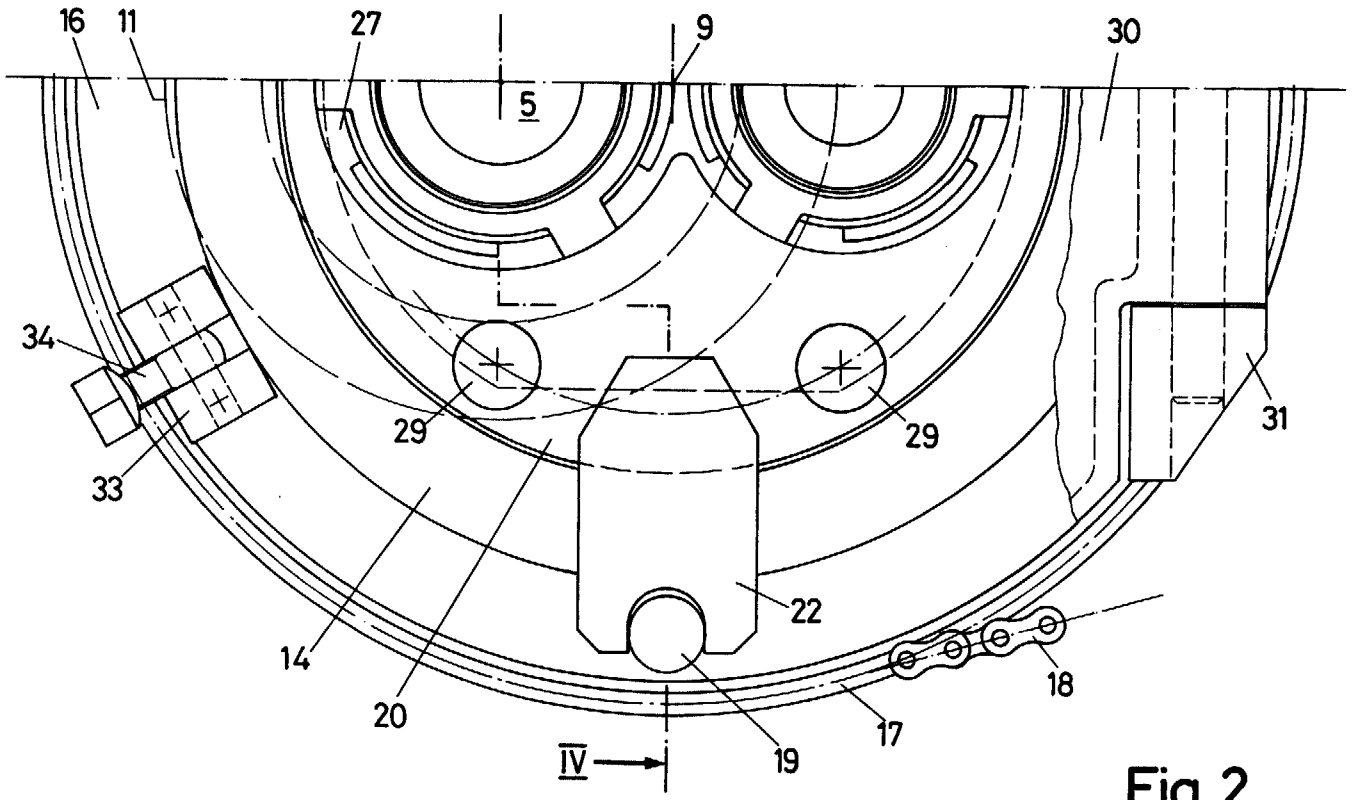
Figure 3:
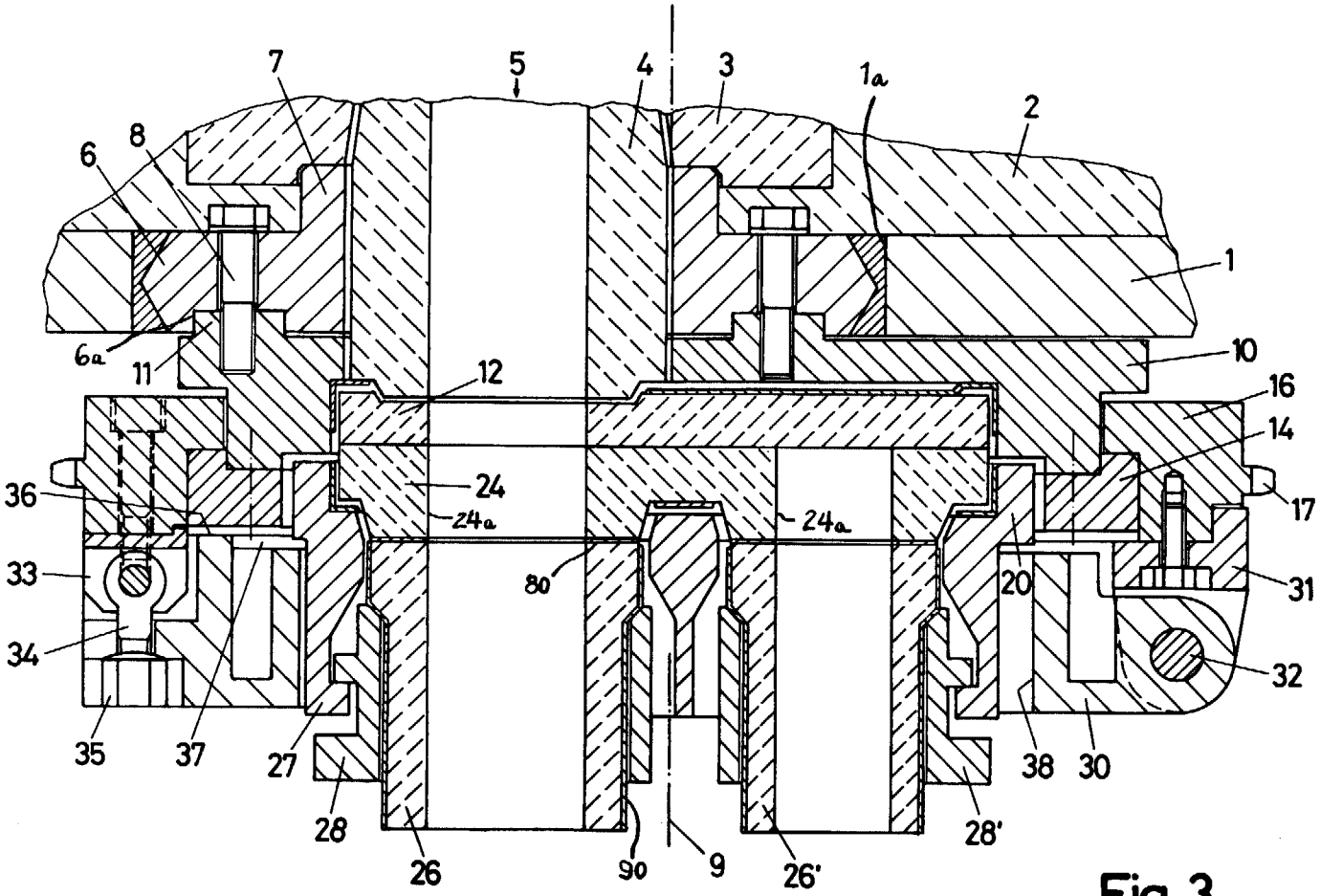
FIG. 3 is a vertical sectional view through the opened bottom closure arrangement or rotary nozzle system mounted at the bottom or base of a steel vessel, the sectional view being taken substantially along the line III—III of FIG. 1.
Figure 4:
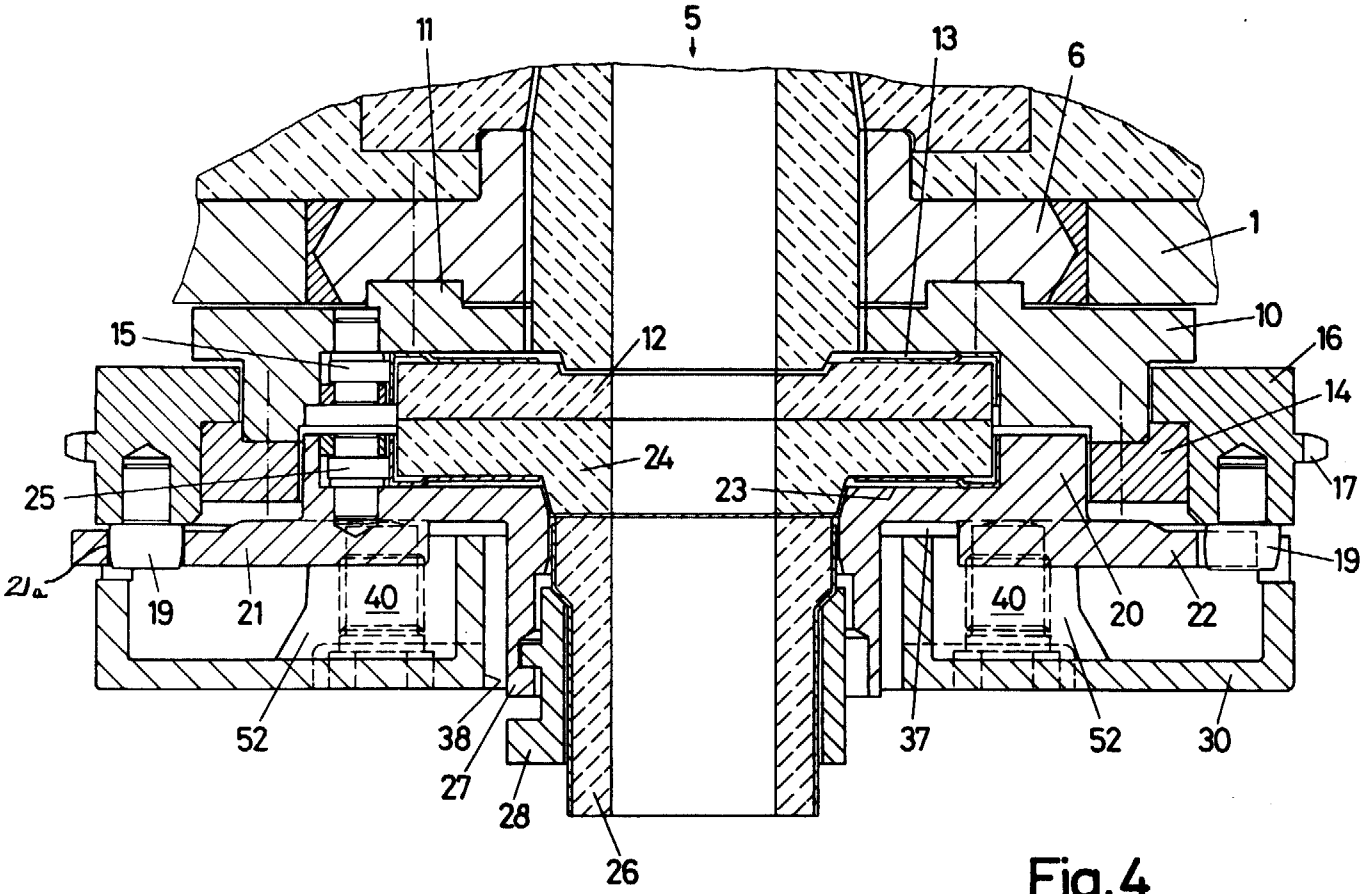
FIG. 4 is a vertical sectional view, like the sectional showing of FIG. 3, but taken along the line IV—IV of FIGS. 1 and 2.

Describing now the drawings, it is to be understood that parts of the casting vessel, here assumed to be a steel ladle, at the base or bottom of which there is installed the rotary nozzle system of the invention, will be apparent from the showing of FIGS. 3 and 4, and, in particular, there will be seen the steel ladle jacket or shell 1 and the refractory lining 2. Within a substantially circular opening 1*a* of the ladle jacket or shell 1 there is attached, as by welding for instance, a flange 6 having a guide sleeve 7. The guide sleeve 7 serves, in conventional manner, for the centering and holding of a perforated or well block 3 and an infeed sleeve or nozzle 4, which constitute the refractory parts of the bottom closure arrangement or rotary nozzle system which are mounted at the casting ladle or other related metallurgical vessel with which the rotary nozzle system is employed. Hence, in the context of this disclosure the term ladle is intended to broadly encompass metallurgical vessels generally, including, but not limited to, ladles and other intermediate vessels for hot metal charges.

The illustrated embodiment of rotary nozzle system is secured as a unit or assembly, by a number of threaded bolts or screws 8 or equivalent fastening expedients, at the flange element or flange 6. This rotary nozzle system will be seen to comprise a stationary closure portion or part containing a base plate 10 in which there is mounted the refractory bottom plate 12 and at which there is fixedly threadably connected or otherwise attached a slide ring 14. The attachment means for the slide ring 14 have been indicated symbolically in FIG. 3 by the broken lines.

Mounted at the slide ring 14 is the rotatable closure element or part, which essentially comprises a rotatable toothed rim or element 16 or equivalent structure, a cover member or cover 30, a pressure or compression plate 20, the refractory slide plate 24 and for each bore 24*a* of the slide plate 24 a related run-out sleeve or pour nozzle 26 and 26′ or equivalent structure.

In the illustrated open position of the rotary nozzle system the refractory parts or elements 4, 12, 24 and 26 form a continuous throughflow channel 5 for the molten metal or melt which is contained within the ladle. This throughflow channel 5 is radially offset with respect to the axis of rotation 9 of the rotatable closure part as discussed above. By rotating the rotatable closure part or portion, whereby the confronting planar surfaces of the plates or plate members 12 and 24 slide upon one another, the rotary nozzle system is partially or completely closed. As illustrated, the slide plate 24 can have two or also more throughflow bores 24*a* which may be of different diameter, at each such bore there being operatively associated at the lower region thereof a related run-out sleeve or pour nozzle, such as the pour nozzles 26 and 26′ discussed above. In the embodiment under discussion, there are used so-called exchangeable run-out sleeves or pour nozzles 26 and 26′, which can be fixedly retained in a fixture 27 of the pressure plate 20 by means of respective bayonet rings 28 and 28′ or equivalent structure. The inflow or infeed sleeve 4 is sealed, for instance by using a suitable refractory mortar, in known manner in relation to the perforated block 3, the guide sleeve 7, the base plate 10 and the bottom plate 12. Between the slide plate 24 and the exchangeable run-out or outflow sleeves or nozzles 26 and 26′ there is mounted, as illustrated, a refractory sealing ring, generally indicated in FIG. 3 by reference character 80. Furthermore, the bottom plate 12, slide or sliding plate 24 and also the pour sleeves or nozzles 26 and 26′, in the embodiment under discussion, are provided with a sheet metal sheathing or enclosure, generally indicated by reference character 90. The plates 12 and 24 possess essentially the same contour and are snugly seated in appropriate recesses or openings 13 and 23 provided at the base plate 10 and the pressure plate 20, respectively, and are fixedly tightened by rotatable eccentric bolts 15 and 25, respectively, or equivalent structure. It is possible to attain the required securement against undesirable rotation of the generally circular configured plates by providing bevelled or cut segment portions at the periphery thereof and through appropriate configuration of the recesses 13 and 23, as is well known in this technology, or by using any other equivalent antirotation means.

The rotary drive of the rotary nozzle system is accomplished at the periphery of the rotatable toothed rim 16, which in the embodiment under discussion is provided with chain teeth 17 or the like, with which there meshes a drive chain 18, as best seen by referring to FIGS. 1 to 4. Of course, other types of rotary drives can be used, and in FIG. 6 there is shown a toothed arrangement or element 17′ for a spur gear drive or another known rotational drive. Preferably, the rotary nozzle system can be rotated, in both directions of rotation, through random angles.

With the inventive rotary nozzle system it is particularly important that at the rotatable closure portion the rotatable toothed rim or element 16 and the therewith releasably attached, rigid cover 30 collectively form a housing 16, 30, or a type of rotatable cage, within which a special pressure plate 20, which receives the refractory slide plate 24, meshingly engages in direct drive coaction, on the one hand, with the rotatable toothed rim 16 and, on the other hand, is supported by means of spring or resilient elements 40 at the aforementioned housing. In the embodiment under discussion there are provided four such spring elements 40. The housing, which is radially and axially guided by means of its rotatable toothed rim 16 at the stationary slide ring 14, forms a fixed base for the application of the contact pressure between the slide plate 24 and the bottom plate 12. The pressure plate 20 is mounted internally of this housing to a certain extent in a so-to-speak "floating" fashion, and the rotational moment, on the one hand, and the contact forces, on the other hand, engage completely independently of one another at the pressure plate 20.

Threadably connected with the rotatable toothed rim 16 is preferably a hinge arrangement or hinge means 31, at which there is articulated by means of the hinge or pivot shaft 32 the cover or cover member 30. Opposite the hinge arrangement 31 there are attached two sockets 33 or equivalent structure for mounting eyelet screws 34, 35 or the like, by means of which the cover 30 can be fixedly tightened at the rotatable toothed rim 16. A respective rib 36*a* provided at the cover 30, and guided about the related eyelet screws or fasteners 34, 35, forms at its end side or face stop or impact surfaces 36, by means of which the cover 30 snugly bears upon the rotatable toothed rim 16, in order to thereby afford a complete rigid connection. Moreover, between the cover 30 and the rotatable toothed rim 16 there is formed an air gap 37, which is only interrupted by the aforementioned surfaces 36. For the throughpassage of the run-out sleeves or pour nozzles 26, 26' and their fixtures 27, there is provided in the cover 30 an opening 38. It is here recalled that the pressure plate 20 together with its fixture 27 does not perform any rotational movement in relation to the cover or cover member 30, so that the opening 38 can be maintained corresponding small, which, in turn, enables realization of a particularly rigid construction of the cover 30.

Figure 5:
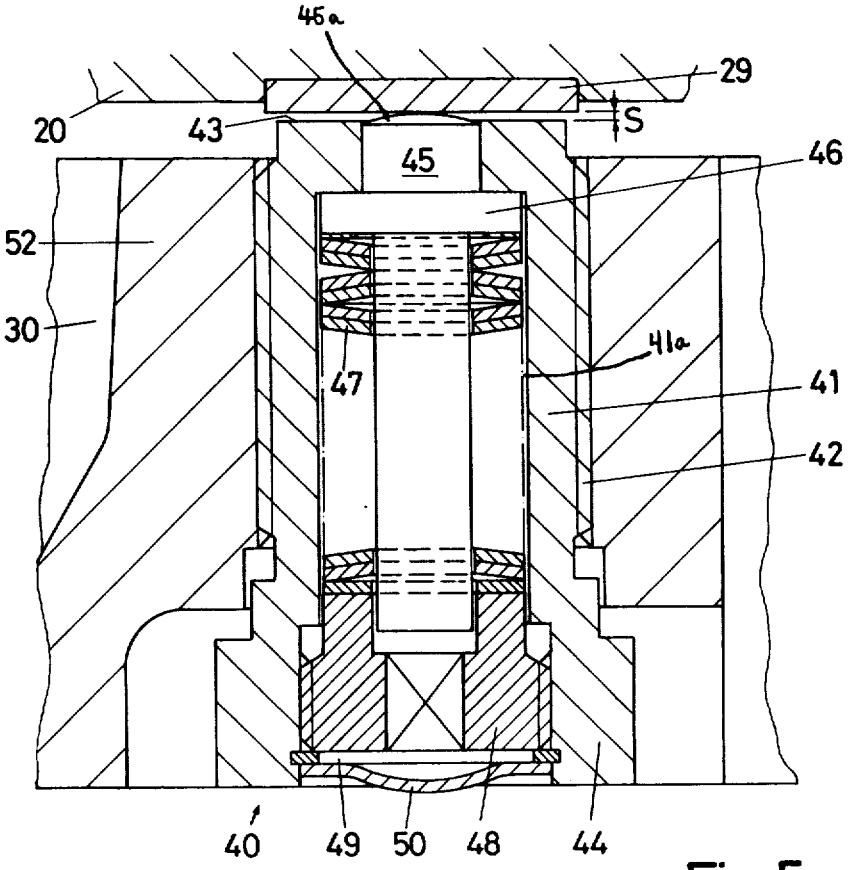
FIG. 5 is a cross-sectional view, on an enlarged scale, taken substantially along the line V—V of the arrangement of FIG. 1, illustrating a preferred construction of a single spring or resilient element.

The four spring or resilient elements 40, which will be discussed more fully hereinafter in conjunction with FIG. 5, are threaded into a respective receiver sleeve 52 of the cover or cover member 30. Due to this good thermally conductive connection it is possible to beneficially avoid that damaging heat dam-up will arise at the spring elements 40. These spring elements 40 are preferably symmetrically distributed about the rotational axis 9, and specifically, are arranged radially at the peripheral or marginal region of the slide plate 24. Advantageously, and as best seen by referring to FIGS. 1 and 2, the contact locations of the spring elements 40 are arranged along a circle which is disposed radially within the plate edge or marginal region. By virtue of these measures there are avoided tilting moments during adjustment of the contact force at the individual spring elements 40, and there is obtained, as a result thereof, a reliable snug contact and a uniform surface pressure or contact action between the refractory plates.

In order to conveniently handle the cover member 30, during its opening and closing movements, a gripping tab or tongue 39 or equivalent structure is located opposite the hinge means 31.

Figure 6:
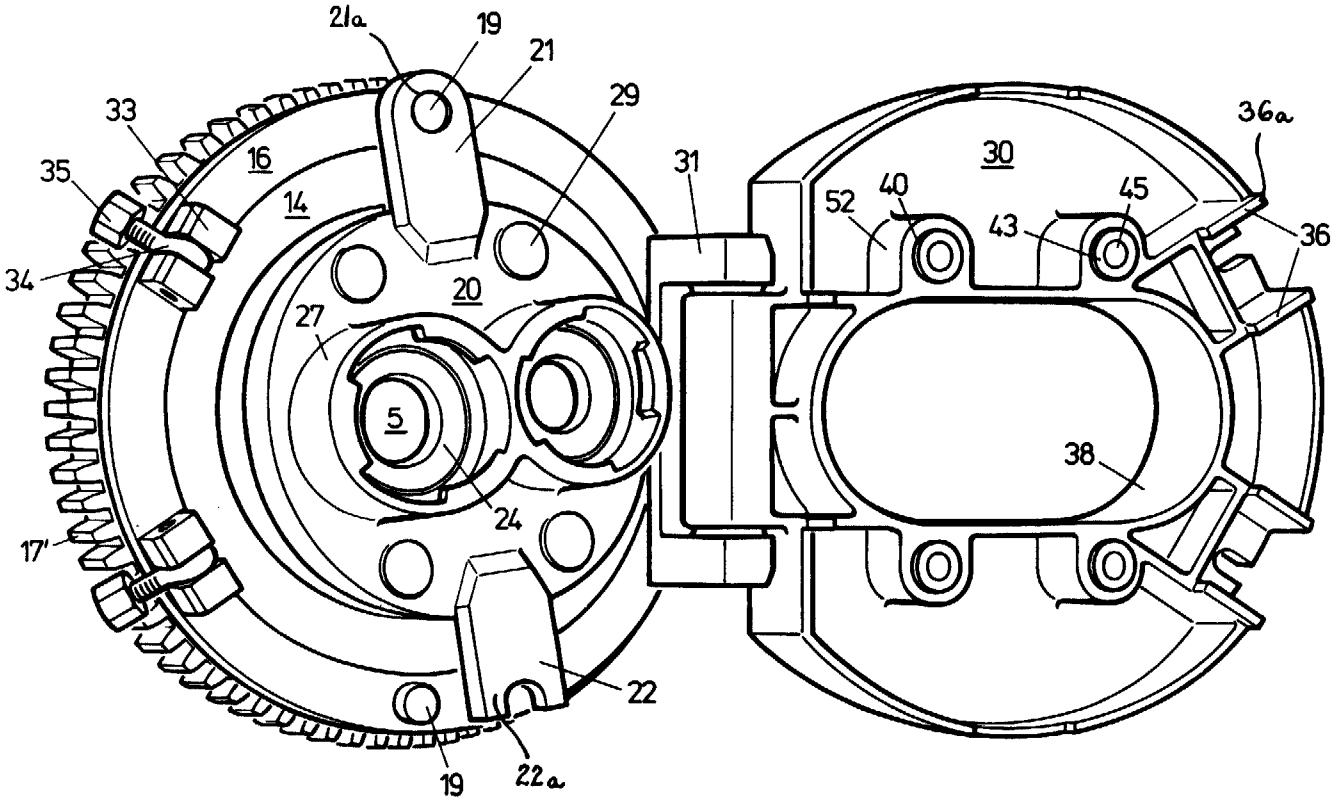
FIG. 6 is a perspective view of the rotary nozzle system showing the cover opened, and wherein for improving clarity and revealing details, the pressure plate has been shown slightly pivoted-out and there have been omitted both of the exchangeable run-out or pouring sleeves with their bayonet rings.

At the locations where the pressure plate 20 bears upon the spring elements 40 there are inserted into the pressure plate 20 hardened discs 29. For the direct transmission of the rotation between the rotatable toothed rim 16 and the pressure plate 20 there are inserted into the rotatable toothed rim 16 two entrainment members 19 at oppositely situated locations, and the pressure plate 20 is provided with radial projections or extension members 21 and 22 which engage over the aforementioned entrainment members or elements 19. The one entrainment member 19 engages with a press fit into a bore 21*a* of the projection 21, whereas the other projection or extension element 22 is bifurcated, as indicated by reference character 22*a* in FIG. 6, and possesses play in the direction of the diameter along which lie the entrainment members 19. Consequently, on the one hand, there is ensured for a centering of the pressure plate 20 with respect to the axis of rotation 9, and, on the other hand, the thermal expansions of the pressure plate 20, arising during operation of the rotary nozzle system, can be taken up free of stress. The projection 21 additionally serves as a suspension bracket for the pressure plate 20, when the cover member 30 is opened, as shown in FIG. 6, during the dismantling and reassembly of the refractory parts. For this purpose it is advantageous if the diameter of the rotatable toothed rim 16, interconnecting the entrainment members 19, extends essentially parallel to the hinge axis or shaft 32. The exchange of the refractory parts, especially the plates or plate members 12 and 24, is accomplished, as is well known, with the ladle in a lying position, i.e. with the ladle floor or bottom extending vertically or upright. The rotatable part has been shown rotated in the showing of FIGS. 1, 2 and 6 into a position where the rotary nozzle system is open and the hinge or pivot shaft 32 is vertically dispositioned. Following release of the eyelet screws 34, 35 the cover 30 can be opened or outwardly pivoted in the manner of a door, as best seen by referring to FIG. 6. For the usually required burning free of the throughflow channel 5, typically for instance by means of an oxygen lance, it is advantageous, if, as illustrated, the hinge means 31 is arranged at the periphery or circumference of the rotatable toothed rim 16 in a manner such that its spacing from the (eccentric) throughflow channel 5 is maximum in the fully opened position of the rotary nozzle system. In this case it is possible to therefore carry out manipulations or working operations at the throughflow channel 5 with the maximum spacing from the opened, hot cover 30. Of course, there is not required any disconnection of the rotary drive at the rotatable toothed rim 16 or the like.

With the cover member 30 opened it is possible to easily remove the pressure plate 20, whereafter the refractory plates 12 and 24 are accessible, and, if desired, can be exchanged along with the sleeve 4. After the exchange the pressure plate 20 is again attached and the cover member 30 is closed and tightened by means of the eyelet screws 34, 35 or equivalent fastening devices. The spring elements 40 continuously remain in their sleeves 52 at the cover member 30. They only need be—and this is so because of the thickness tolerance of the refractory plates—newly adjusted in each case after tightening the cover member 30, to a predetermined rotational moment and the requisite contact force.

The pressure plate 20 only contacts by means of its projections 21 and 22 the entrainment members 19 and by means of its point contacts (discs 29) bears upon the spring elements 40 and is moreover surrounded with play by the enclosing metal parts. In this way there is ensured that the heat withdrawal to the surroundings, and therefore, the heat loading, especially of the housing parts 16 and 30 and, in particular, the spring elements 40, remains comparatively low. The heating effect is therefore beneficially limited to those parts which can be rapidly and simply exchanged, and the strength and dimensional stability of the remaining parts is ensured for.

Additionally, it is to be appreciated that the illustrated detachable connection between the flange element or flange means 6 and the base plate 10 of the rotary nozzle system contributes to the advantage that the distortions or warping of the ladle shell or jacket 1, arising during operation, are not extensively transmitted to the supporting parts of the rotary nozzle system, particularly the base plate 10. The connection is accomplished by means of a substantially circular tongue or centering rib 11, arranged concentrically with respect to the throughflow channel 5, which engages into a ring-shaped groove 6a in the flange means 6 and is pierced by the attachment bolts 8 or equivalent structure. At the same time this connection forms the centering and also the axial contact or support arrangement between the parts, i.e. the base plate 10 is freely supporting externally of the rib means 11. This rib means 11 is preferably located radially within the rotatable toothed rim 16, i.e. it has a relatively small diameter, so that there prevails only a small connection basis between the ladle jacket 1 and the rotary nozzle system, at which there can be hardly transmitted disadvantageous deformations.

A particularly suitable construction of a spring element 40 has been shown in longitudinal sectional view in FIG. 5. It possesses a sleeve member 41 provided with external threading or threads 42, the sleeve member 41 being threaded into its receiving or receiver sleeve 52 of the cover member or cover 30. The sleeve member 41 is provided at one end face or side with an impact or contact surface 43 and at the other end, confronting the outer surface of the cover member 40, there is provided an adjustment head 44 or equivalent structure. Internally of the sleeve member 41 there is guided to be lengthwise movable a plunger 45, whose upper rounded end 45a protrudes past the impact or contact surface 43 in order to contact the disc 29 of the pressure plate 20. The plunger 45 is provided with a collar 46. Between the collar 46 and a threaded plug 48 which has been threaded into the adjustment head 44, there is biased a package of plate springs 47 or the like. The threaded plug 48 serves for adjusting the spring pre-bias which acts upon the plunger 45 and is axially secured in its adjusted position by means of an expanding ring 49. The internal bore 41a of the sleeve member 41 is closed by an inserted cover 50.

In each case following the closing and tightening of the cover member 30 the spring elements 40 are tightened, by means of the adjustment head or adjustment means 44, so as to exert a predetermined rotational moment or torque. Advantageously, the pre-biasing or pre-stressing of the spring elements 47 is greater than the contact force exerted, with the aforementioned rotational moment, by the plunger 45 upon the disc 29, and a play S (FIG. 5) remains between the contact surface 43 and the disc 29. This situation corresponds to the relatively cold condition which prevails, in each instance, upon placing into operation the closed rotary nozzle system. If at a later point in time the rotary nozzle system is opened and the melt flows out through the channel 5, then especially there rapidly occurs at the refractory plates 12 and 24 an intensive heating, and thus, related thickness expansion of the material. Consequently, the pre-stress of the spring elements 47 is overcome and there is eliminated the play S, and thereafter in a short amount of time the disc 29 snugly bears against the contact surfaces 43. Hence, there prevails a completely stable pre-biasing of the rotary nozzle system, and by virtue of the support of the pressure plate 20 at the housing, its rotatable toothed rim 16 is pressed axially against the slide ring 14 and is therefore additionally stabilized against "tilt movements" owing to the action of the rotatable drive.

By virtue of the rigid connection of the cover member 30 and the rotatable toothed rim 16 by means of the hinge arrangement 31 and the fastening screws 34, 35 and the impact or contact surfaces 36, but each time with newly adjusted spring elements 40, there is positively always again produced the same contact conditions at the slide surface (sealing surface) between the plates 12 and 24, even in the presence of possibly arising thickness differences of such plates 12 and 24 by virtue of the manufacturing tolerances. Since the amount, by which the plunger 45 protrudes past the end face-impact surface 43, and thus the starting play S (FIG. 5) is advantageously chosen to be somewhat smaller than the thermal thickness expansion of the plates 12 and 24, which is to be expected during system's operation, there rapidly and reliably occurs the aforementioned "hard" support of the pressure plate 20 by elimination of such play S. But even then if initially there remains a slight play S, still due to the rigid impact or contact surfaces 43 there is positively prevented, in any event, a dangerous spreading apart of the plates 12 and 24 and a so-to-speak "drawing-in" of the melt between such plates 12 and 24. This enables the use of only a slight number of spring elements 40, preferably four such spring elements, wherein the pressure plate 20 ensures for a good pressure distribution at the slide plate 24.

As has been already mentioned previously, it is also possible to use a different number and arrangement of the throughflow bores 24a and the slide plate 24 with the thereafter connected run-out sleeves or pour nozzles 26 and 26', in which case there is to be appropriately accommodated the arrangement of the spring elements 40 about the rotational axis 9. In principle, it would also be possible to provide a different construction of the housing in that, for instance, the rotatable toothed rim 16 and the cover member 30 could be pre-biased by adjustable spring elements and the pressure plate 20 could be directly supported at the cover member 30. For the rotatable drive of the rotary nozzle system there can be selectively used, by way of example and not limitation, an electric drive motor or a hydraulic drive, which has not been particularly shown since such drive units are well known.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A rotary nozzle system for metallurgical vessels, especially steel casting ladles, comprising:
   - a stationary closure portion containing a refractory bottom plate;
   - a rotatable closure portion which is rotatable in relation to the stationary closure portion;
   - said rotatable closure portion comprising a rotatable toothed rim mounted at the stationary closure portion and a refractory slide plate resiliently bearing against the bottom plate;
   - said rotatable closure portion being structured as housing means;
   - said housing means comprising a rigid cover member detachably secured at the rotatable toothed rim;
   - a pressure plate for receiving the slide plate and contained within said housing means;
   - said pressure plate being in direct rotatable engagement with said rotatable toothed rim; and spring elements for supporting said pressure plate at said housing means.

2. The rotary nozzle system as defined in claim 1, wherein:

said spring elements are arranged in said cover member;

tightening elements and impact surface means provided for said cover member; and said cover member being rigidly connectable with said rotatable toothed rim by means of said tightening elements and said impact surfaces.

3. The rotary nozzle system as defined in claim 2, further including:

receiver sleeve means provided for said cover member; and said spring elements being inserted in a good thermally conductive fashion in said receiver sleeve means.

4. The rotary nozzle system as defined in claim 2, wherein:

a free air gap is present between the cover member and the rotatable toothed rim; and said air gap only being interrupted by localized contact locations.

5. The rotary nozzle system as defined in claim 1, wherein:

said rotatable closure portion has an axis of rotation;

said spring elements being distributed about the axis of rotation of said rotatable closure portion; and said spring elements being arranged at a radial marginal region of said slide plate.

6. The rotary nozzle system as defined in claim 5, wherein:

said spring elements are arranged along a circle radially within a marginal edge of said slide plate.

7. The rotary nozzle system as defined in claim 1, further including:

means defining contact locations for said spring elements;

means defining rotatable engagement locations between said pressure plate and said rotatable toothed rim; and said pressure plate, with the exception of said means defining said rotatable engagement locations and said means defining said contact locations for the spring elements, is surrounded with play in relation to said housing means and the stationary closure portion.

8. The rotary nozzle system as defined in claim 7, wherein:

said means defining the rotatable engagement locations comprises two entrainment members arranged between said pressure plate and said rotatable toothed rim; and said two entrainment members being situated diametrically opposite one another along a diameter of said rotatable toothed rim.

9. The rotary nozzle system as defined in claim 8, wherein:

said rotatable engagement means further includes two projection means provided for said pressure plate and intended to engage with said entrainment members; and one of said projection means engaging with a press fit with a related one of the entrainment members and the other projection means engaging with play, which is present in the direction of the diameter of the rotatable toothed rim, with the other entrainment member.

10. The rotary nozzle system as defined in claim 8, further including:

hinge means for interconnecting the cover member with said rotatable toothed rim;

said hinge means including a hinge axis; and said diameter of said rotatable toothed rim extending essentially parallel to said hinge axis.

11. The rotary nozzle system as defined in claim 10, further including:

means defining a throughflow channel;

the position of said hinge means being selected at the circumference of the rotatable closure portion such that in a completely opened position of the rotary nozzle system the hinge means is at the greatest spacing from the throughflow channel.

12. The rotary nozzle system as defined in claim 1, wherein:

said pressure plate is provided with at least one fixture means for the reception of a refractory pour sleeve merging with a bottom face of the slide plate.

13. The rotary nozzle system as defined in claim 1, further including:

means defining a throughflow channel;

said stationary closure portion including a base plate;

flange means adapted to be fixedly inserted into a metallic wall means of the metallurgical vessel;

means for detachably connecting said base plate with said flange means;

said detachably connecting means comprising a substantially circular tongue-and-groove connection means between the base plate and the flange means and arranged concentrically with respect to the throughflow channel; and said tongue-and-groove connection means forming both an axial contact surface and establishing a centering action between both said base plate and said flange means.

14. The rotary nozzle system as defined in claim 1, further including:

fastening means piercingly extending through said tongue-and-groove connection means.

15. The rotary nozzle system as defined in claim 14, wherein:

said tongue-and-groove connection means together with a hole circle of said fastening means is located radially within the rotatable toothed rim.

16. The rotary nozzle system as defined in claim 1, further including:

at least one sleeve means having external threading;

said spring elements comprising compression spring elements arranged in said sleeve means;

said sleeve means being provided with an end face-impact surface and at its opposite end with an adjustment head;

a plunger arranged internally of said sleeve means and protruding past said impact surface;

said plunger being guided to be axially movable within said sleeve means; and said spring elements containing at least one spring biased between said plunger and said sleeve means.

17. The rotary nozzle system as defined in claim 16, wherein:

said plunger is provided with a collar;

a threaded plug provided for said plunger;

said spring element being biased between said collar of the plunger and said threaded plug; and said threaded plug being threaded into said adjustment head for the purpose of adjustably pre-biasing the spring.

18. A rotary nozzle system for metallurgical vessels, comprising:

a fixed bottom plate;

a slide plate coacting with said fixed bottom plate;

rotatable closure means containing therein said slide plate;

a pressure plate cooperating with said slide plate and arranged within said rotatable closure means;

said rotatable closure means comprising:

a rotatable drive portion for rotating said pressure plate; and a cover member displaceably mounted at said rotatable drive portion; and said slide plate, said pressure plate, said rotatable drive portion and said cover member being rotatable about a common axis.

19. The rotary nozzle system as defined in claim 18, wherein:

said rotatable closure means includes resilient means acting upon said pressure plate for biasing said pressure plate towards said slide plate.

20. A rotary nozzle system for metallurgical vessels: comprising:

a fixed bottom plate;

a slide plate coacting with said fixed bottom plate;

rotatable closure means containing therein said slide plate;

a pressure plate cooperating with said slide plate and arranged within said rotatable closure means;

said rotatable closure means comprising:

a rotatable drive portion for rotating said pressure plate;

a cover member displaceably mounted at said rotatable drive portion; and hinge means for pivotably connecting said cover member with said rotatable drive portion.

21. In a rotary nozzle system for metallurgical vessels, containing a fixed bottom plate and a slide plate coacting with said fixed bottom plate, the improvement which comprises:

a separate rotatable pressure plate cooperating with said slide plate;

said separate rotatable pressure plate and said slide plate constituting respective individual parts;

means for releaseably interconnecting the slide plate and pressure plate in rotary engagement;

a rotatable portion for rotating said rotatable pressure plate; and a plurality of separate resilient means located in said rotatable portion at spaced locations from one another and acting upon said pressure plate for biasing said pressure plate towards said slide plate, and said plurality of separate resilient means rotating in conjunction with said rotatable portion.

22. The rotary nozzle system as defined in claim 21, further including:

means for providing a direct driving connection between said rotatable pressure plate and said rotatable portion.

23. The rotary nozzle system as defined in claim 22, wherein:

said direct driving connection means comprises at least one radial extending member provided at said pressure plate and engaging with said rotatable portion.

24. The rotary nozzle system as defined in claim 21, further including:

at least one pour nozzle coacting with said slide plate for teeming a molten metal; and means for releasably supporting said pour nozzle at said pressure plate.

25. The rotary nozzle system as defined in claim 24, wherein:

said means for releasably supporting said pour nozzle at said pressure plate comprises quick action-fixing and releasing means.

26. The rotary nozzle system as defined in claim 21, further including:

rotary engagement means effective between said rotatable pressure plate and said rotatable portion independent of said resilient means.

27. The rotary nozzle system as defined in claim 21, further including:

means acting between said rotatable pressure plate and said rotatable portion for rotating said pressure plate independent of said resilient means.

28. The rotary nozzle system as defined in claim 21, wherein:

said plurality of resilient means are incorporated in a rigid structure forming part of said rotatable portion.

29. The rotary nozzle system as defined in claim 28, further including:

means for detachably securing said structures to a driving part of said rotatable portion.

30. The rotary nozzle system as defined in claim 29, wherein:

said structure enables said resilient means to be collectively conjointly movable out of engagement with said pressure plate.

31. The rotary nozzle system as defined in claim 21, wherein:

said plurality of resilient means are integrated into a structure forming part of said rotatable portion.

32. The rotary nozzle system as defined in claim 21, further including:

means for conjointly moving said resilient means out of engagement with said pressure plate.

33. The rotary nozzle system as defined in claim 21, further including:

common means for collectively supporting said resilient means.

34. The rotary nozzle system as defined in claim 33, wherein:

said common means comprises a cover member.

35. A rotary nozzle system for metallurgical vessels, comprising:

a stationary closure portion;

a rotatable closure portion which is rotatable in relation to the stationary closure portion;

said stationary closure portion including a base plate;

flange means adapted to be fixedly inserted into metallic wall means of the metallurgical vessel;

means for releasably connecting said base plate with said flange means;

said releasably connecting means comprising tongue-and-groove means for interconnecting said base plate and said flange means with one another; and said tongue-and-groove means providing both an axial contact surface and affording a centering action between said base plate and said flange means.

36. In a rotary nozzle system for metallurgical vessels, containing a fixed bottom plate and a slide plate coacting with said fixed bottom plate, the improvement which comprises:

a separate rotatable pressure plate cooperating with said slide plate;

said separate rotatable pressure plate and said slide plate constituting respective individual parts;

means for releasably interconnecting the slide plate and pressure plate in rotary engagement;

a rotatable portion for rotating said rotatable pressure plate;

a plurality of separate resilient means located in said rotatable portion at spaced locations from one another and exerting forces at spaced locations from one another upon said pressure plate for biasing said pressure plate towards said slide plate, and said plurality of separate resilient means rotating in conjunction with said rotatable portion; and a toothed element coacting with said rotatable portion.

* * * * *

UNITED STATES PATENT OFFICE

CERTIFICATE OF CORRECTION

PATENT NO. : 4,480,771

DATED : November 6, 1984

INVENTOR(S) : ERNST MEIER

It is certified that error appears in the above-identified patent and that said Letters Patent are hereby corrected as shown below:

Column 6, line 57, before "heat" please insert --thermal or--

Column 12, line 31 (Claim 29, line 3) please delete "structures" and insert --structure--

Signed and Sealed this

Second Day of April 1985

[SEAL]

*Attest:*

DONALD J. QUIGG

*Attesting Officer* *Acting Commissioner of Patents and Trademarks*